US007602283B2

(12) United States Patent
John

(10) Patent No.: US 7,602,283 B2
(45) Date of Patent: Oct. 13, 2009

(54) ACTIVE MONITORING SYSTEM FOR USE WITH A GARAGE DOOR OPENER

(75) Inventor: Thomas John, Roslyn, NY (US)

(73) Assignee: American Business Solutions, LLC, New Hyde Park, NY (US)

( * ) Notice: Subject to any disclaimer, the term of this patent is extended or adjusted under 35 U.S.C. 154(b) by 579 days.

(21) Appl. No.: 11/344,949

(22) Filed: Jan. 31, 2006

(65) Prior Publication Data

US 2006/0202815 A1 Sep. 14, 2006

Related U.S. Application Data

(63) Continuation-in-part of application No. 11/283,063, filed on Nov. 17, 2005, now abandoned.

(60) Provisional application No. 60/648,852, filed on Feb. 1, 2005, provisional application No. 60/703,019, filed on Jul. 26, 2005.

(51) Int. Cl.
*G08B 1/08* (2006.01)

(52) U.S. Cl. ..... 340/539.11; 340/539.13; 340/932.2

(58) Field of Classification Search ..... 340/539.1, 340/539.11, 539.18, 539.22, 539.26, 531, 340/521, 628, 539.13, 932.2; 318/16, 266, 318/283; 49/141, 25
See application file for complete search history.

(56) References Cited

U.S. PATENT DOCUMENTS

| | | | | |
|---|---|---|---|---|
| 4,464,651 | A * | 8/1984 | Duhame | 340/521 |
| 6,472,985 | B1 | 10/2002 | Bruwer et al. | |
| 7,113,090 | B1 * | 9/2006 | Saylor et al. | 340/539.18 |
| 2003/0071590 | A1 | 4/2003 | Roman | |
| 2003/0140107 | A1 * | 7/2003 | Rezvani et al. | 709/208 |
| 2004/0212498 | A1 | 10/2004 | Peterson et al. | |
| 2005/0086366 | A1 * | 4/2005 | Luebke et al. | 709/238 |

* cited by examiner

*Primary Examiner*—Van T. Trieu
(74) *Attorney, Agent, or Firm*—Leason Ellis LLP

(57) ABSTRACT

According to aspect of the present invention, an automatic garage door opener is provided and includes: (1) a mechanical mechanism operatively coupled to the garage door for opening and closing thereof; (2) a main control unit for processing command signals to open and close the garage door; (3) a remote control unit in operative communication with the main control unit and capable of sending the command signals; and (4) an active monitoring system that is operatively associated and in communication with the main control unit and the remote control unit, wherein the active monitoring system is configured to send an alert to the remote control unit upon the occurrence of a prescribed event, such as the detection of a gas within the garage at a concentration greater than a predetermined threshold. The main control unit is preferably configured to deliver a control signal to open the garage door upon the occurrence of the gas exceeding the threshold level.

25 Claims, 6 Drawing Sheets

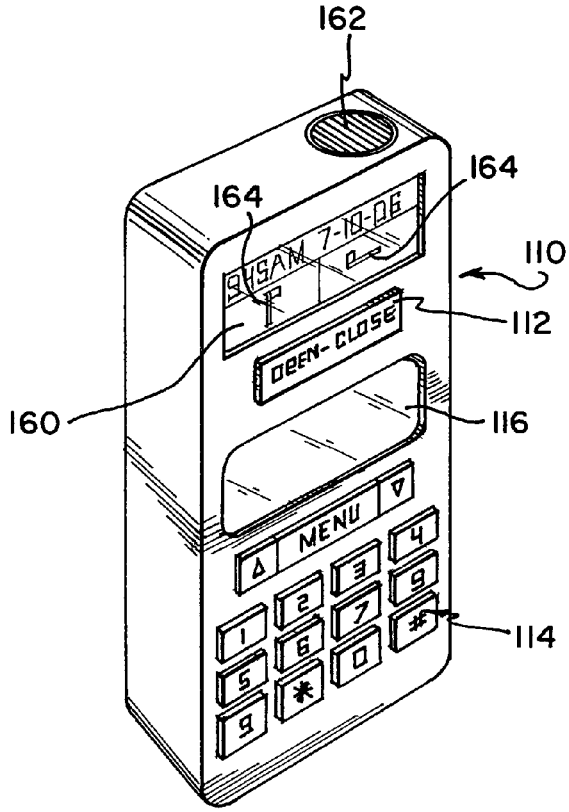
FIG. 2
FIG. 4
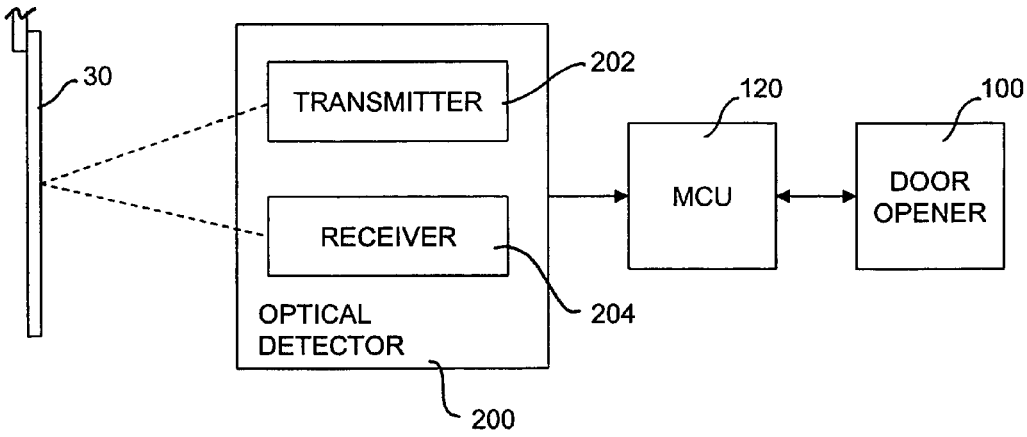

ACTIVE MONITORING SYSTEM FOR USE WITH A GARAGE DOOR OPENER

CROSS-REFERENCE TO RELATED APPLICATIONS

This present application is a continuation-in-part of U.S. patent application Ser. No. 11/283,063, filed Nov. 17, 2005, and which claims the benefit of U.S. Provisional Patent Application Nos. 60/648,852, filed Feb. 1, 2005, and 60/703,019, filed Jul. 26, 2005, all of which are hereby incorporated by reference in their entirety.

TECHNICAL FIELD

The present invention relates to automatic door opening mechanisms, and more particularly, relates to a security feature that is configured for use with an existing or new garage door opener system for alerting an operator that the garage door is in an undesirable condition, e.g., the garage door remains open for a predetermined period of time and the security feature is in an active mode.

BACKGROUND

Increasingly over time, products are introduced to make one's life easier and one type of product like this is an automatic garage door opener. Before the introduction of the automatic garage door opener, homeowners and the like had to manually open and close the garage door. This was a very labor intensive task since the garage door is of a significant weight that prevented many people from even performing the task as well as being a time intensive task since it required an operator of the vehicle to first pull the vehicle closer to the door then disembark from the vehicle to open the door manually and then subsequently return to the vehicle to drive into the garage before then disembarking the vehicle for a second time to close the door and enter the house, etc. The introduction of the automatic garage door opener system that could be operated within the confines of the vehicle eliminated all of the hassles associated with manual operation of the garage door.

A garage door opener system typically includes a mechanical drive system that is disposed within the interior of the garage and is coupled directly to the garage door such that actuation of the mechanical drive system causes a controlled opening and closing of the garage door. The garage door opener system includes a remote control or transponder that is programmed to work with the mechanical drive system to permit operation of the mechanical drive system from a remote location, such as an interior of the vehicle. The mechanical drive system thus includes a control unit or CPU that communicates with the remote control to permit the controlled opening and closing of the garage door. The remote control is fairly small in size and therefore, can be clipped to a vehicle's visor or carried in a purse or stored in a glove box or even placed on a key chain. In addition, most garage door opener systems also have control pads that act like the remote control but are permanently installed at a specified location to permit operation of the garage door at this location by manipulation of the control pad. For example, the key pad can be in the form of a control unit that is installed as a wall console or it can be an outdoor key pad that is located near the garage door. These types of control units permit the operator to open and close the garage door at the specified, strategic locations such as near an entry way between the living quarters of the house and the garage.

Once the garage door is shut, the mechanical drive system keeps the garage door locked. Garage door opener systems are safer, more affordable and provide more security than ever before. The obvious security that it provides is that it keeps intruders out of one of the largest openings or entry points into your home (your garage). Yet for all the security features built into modern day garage door opener systems, they still have a compromising security flaw, namely the garage door will remain open if left open. This may happen under a number of different circumstances. One being that the homeowner may be in a hurry and could overlook closing the garage door after the homeowner leaves the property. Another circumstance is that the batteries in the remote control can be weak or dead (hence not functioning properly) and the homeowner might drive away thinking that the garage door opener system has been activated to close the garage door, while in reality, it has not been and the garage door remains open.

Thus, there is a need for an additional safety feature that can be implemented in new or existing garage door opener systems and is constructed to overcome the above noted deficiencies associated with a garage door being accidentally left open.

SUMMARY

According to aspect of the present invention, an automatic garage door opener is provided and includes: (1) a mechanical mechanism operatively coupled to the garage door for opening and closing thereof; (2) a main control unit for processing command signals to open and close the garage door; (3) a remote control unit in operative communication with the main control unit and capable of sending the command signals; and (4) an active monitoring system that is operatively associated and in communication with the main control unit and the remote control unit, wherein the active monitoring system is configured to send an alert to the remote control unit upon the occurrence of a prescribed event.

According to one exemplary embodiment, the prescribed event is the detection of a gas, such as smoke or carbon monoxide, within the garage at a concentration greater than a predetermined threshold. The main control unit is preferably configured to deliver a control signal to open the garage door upon the occurrence of the gas exceeding the threshold level.

Other features and advantages of the present invention will be apparent from the following detailed description when read in conjunction with the accompanying drawings.

BRIEF DESCRIPTION OF THE DRAWING FIGURES

The foregoing and other features of the present invention will be more readily apparent from the following detailed description and drawings figures of illustrative embodiments of the invention in which:

FIG. 2 is a perspective view of remote control unit for use with the door opener system of FIG. 1;

FIG. 4 is a schematic view of an optical detector incorporated into the garage door opener system of FIG. 1;

DETAILED DESCRIPTION OF PREFERRED EMBODIMENTS

Figure 1:
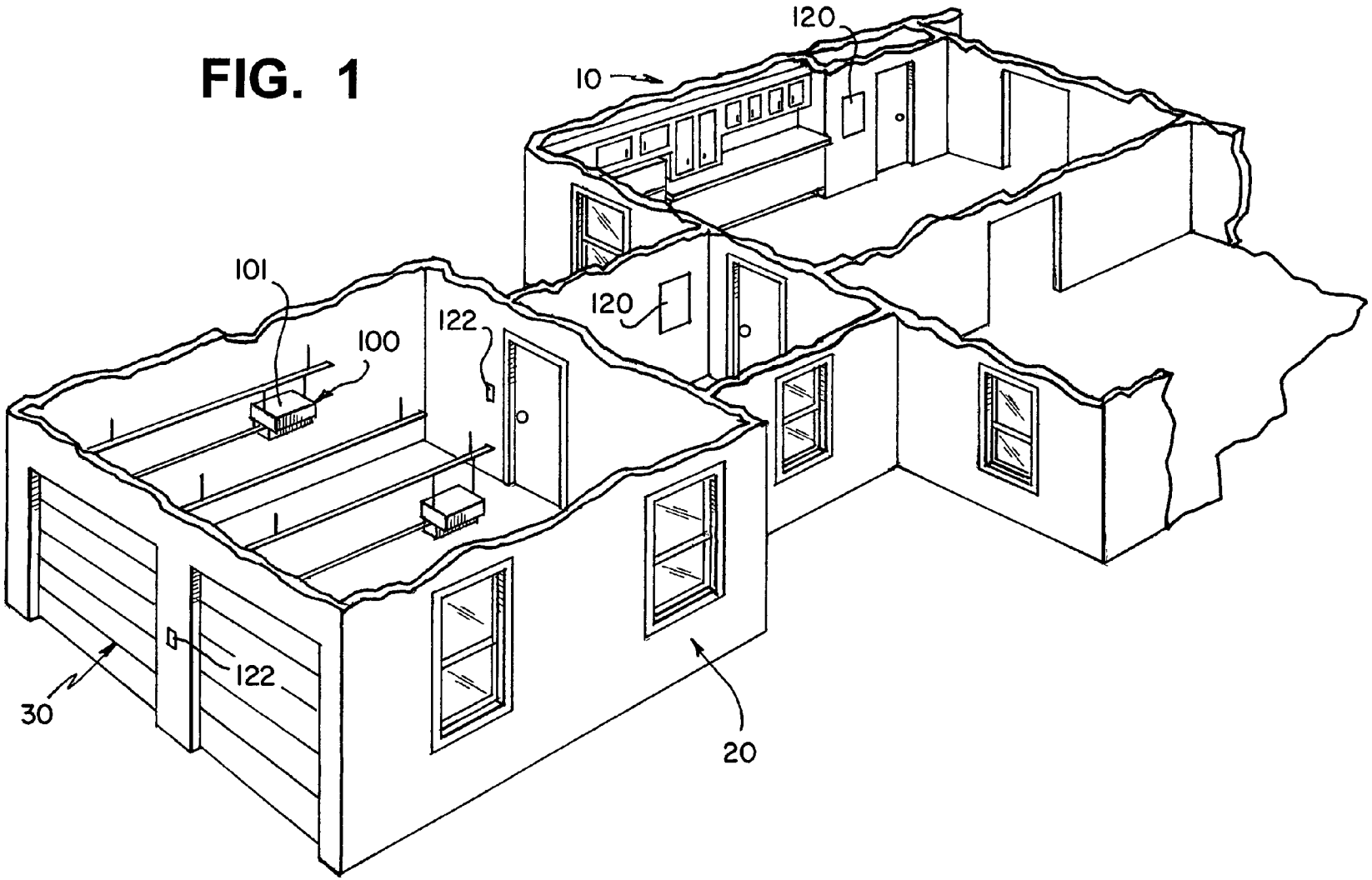
FIG. 1 is a perspective view of a house with a garage door opener system according to the present invention installed therein.

Referring now to FIG. 1, a house 10 is shown with an attached garage 20 that includes a garage door 30. House 10 is of the type that includes an entry way 40 directly into the house 10 from within an interior of the garage 20. In other words, a person can directly enter the living quarters of the house 10 from inside of the garage 20 and therefore, the garage 20 provides an easy entry point into the house 10, one which should be secured at all times. However, it will be understood that this precise arrangement between the house 10 and the garage 20 is only exemplary and non-limiting in nature and that a number of other arrangements are also possible. The garage 20 includes an automatic garage door opener (system) 100 that is operatively connected to the garage door 30 to permit the controlled opening and closing of the garage door 30 on the command of the homeowner. It will be understood that the automatic garage door opener 100 can be any number of commercially available systems that are for sale now or in the future or it can be an earlier installed system since one of the advantages of the present invention is that it complements existing installed systems and therefore permits easy retrofitting of such systems. The opener 100 typically uses an actuatable and controllable motor 101 to cause the movement of the door 30.

As with most existing automatic garage door openers 100, the garage door opener 100 includes a remote control unit 110 (FIG. 2) that is communicatively and operatively connected to the garage door opener 100 such that the operator, through buttons or like on the remote control 110, can at least perform the operations of opening the garage door 30 and closing the garage door 30 as by pressing a button or the like 112 on the remote control 110. In addition, the remote control 110 can include a programmable keypad 114 that permits the operator to perform a number of other operations through the remote control 110. For example, the operator can turn a garage light on or off by pressing a button.

For purpose of illustration only, the automatic garage door opener 100 is of the type that includes at least one local, permanently installed master control unit 120 that is operatively and communicatively connected to the garage door opener 100 so that operation of the garage door 30 can be controlled through the unit 120. In one embodiment, the control unit 120 is of a programmable type and includes at least one input that assists the operator in configuring the garage door opener 100 to the needs and desires of the operator. For example, the unit 120 can be of the type that permits the operator to program and change the time period that the light stays illuminated after the door 30 is either opened or closed; or the operator can set a security code such that operation of the door opener 100 requires the operator to first input a security code (e.g., password) before the garage door opener 100 will work. The master control unit 120 can include one or more local control or key pads 122.

In general terms, the present invention is directed to a security feature that is implemented with the garage door opener 100 to do at least one of the following (1) track and log when the garage door opener 100 has been actuated to either open or close the garage door 30; (2) display the current status (position) of the garage door 30; (3) send an alarm or some type of visual/audio indicator to the operator through the remote control 110 or a handheld unit under prescribed conditions to indicate that the garage door 30 is in the open position; and (4) permit the operator to take remedial action once the operator has been alerted to one of the existence of one of the prescribed conditions. A number of different systems will be described below, with reference to the various figures, which include one or more of the preceding functions to illustrate the general make-up and advantages of the present invention.

Figure 3:
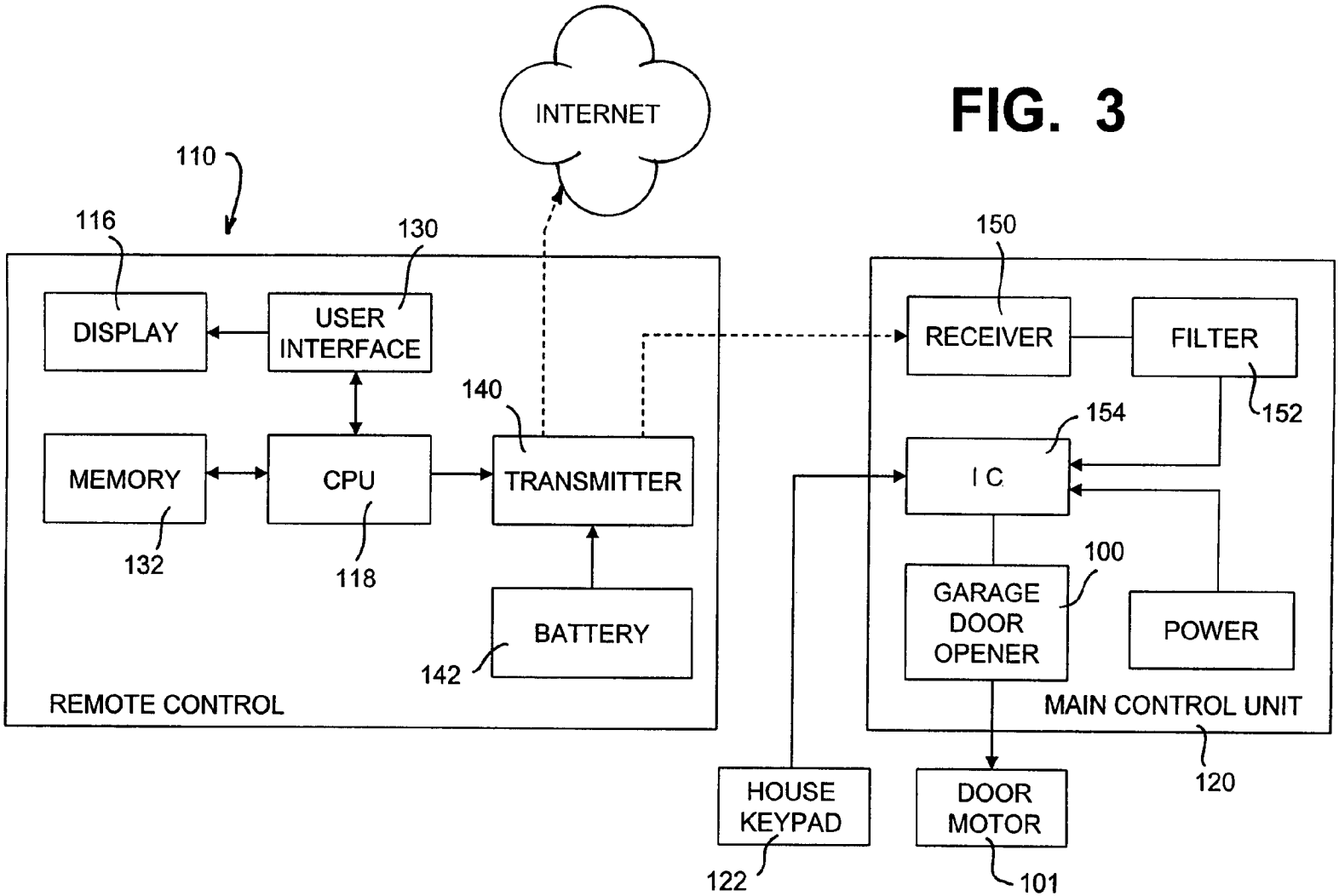
FIG. 3 is a schematic view of an interface between the remote control unit and the main control unit of the door opener system.

FIGS. 1 and 3 illustrate an embodiment that implements the first objective or function listed above in that the garage door opener (system) 100 is configured so that the remote control 110 includes a display 116 that permits certain indicia relating to the status or condition of the garage door 30 to be displayed. For example, the remote control 110 includes amongst other things a central processor (CPU) 118 as well as a user interface 130 that permits the operator to scroll through a menu that is displayed on the display 116 and permits the operator to enter certain commands, such as a command to either open of close the garage door 30. The CPU 118 and user interface 130 are both operatively connected to a memory 132 that stores certain information as described below. The display 116 is preferably a digital display, similar to those found in other handheld devices, e.g., handheld mobile communication devices.

It will be appreciated that the remote control 110 can be of the type that is an independent hand-held transportable device that is carried in the vehicle. Alternatively, the remote control 110 can be of the type that is integrated into the vehicle itself, such as the programmable master remote control units that are present in many upscale vehicles today. So long as this type of programmable remote unit can be programmed to function in the desired manner and so long as it includes some type of alert (e.g., visual display means or audio alert means), it is suitable for use in the present invention and is set up using traditional programming protocol.

According to one embodiment and one operation mode, the display 116 displays the time and preferably the date in one area or region of the display 116. As used herein, this information is described as time related information. The manner or layout of the time related information can be changed by the operator through the user interface 130 where a menu is accessed and permits the operator to, for example, select that the date includes either a text readout for the month or is simply a numeric readout, etc.

The remote control 110 communicates with the main control unit 120 of the garage door opener 100 using conventional protocol. For example, the remote control 110 can communicate via radio waves or can communicate via command signals that are sent via satellite between a transmitter and a receiver or the two can communicate via another type of network such that communication with the main control unit of the garage door opener 100 is realized.

Most garage door openers are radio controlled devices in that the remote control 110 acts as a hand held transmitter 140 that controls the operation of the garage door opener 100 by sending radio waves to a receiver 150 that is associated with the main control unit 120 of the automatic garage door opener 100 and typically, includes an antenna and circuit board inside a control unit that receives signals from the transmitter 140 and activates the garage door mechanism as commanded by the transmitter 140. The remote control 110 (transmitter) sends a signal over a frequency to the receiver of the garage door opener 100. The transmitter 140 has a power source, usually a battery, 142 that provides the power for the controls and transmission of the signal. Most garage door openers 100 operate at either 27 MHz or 49 MHZ—the pair of frequencies that has been allocated by the FCC for basic consumer items. The remote control 110 preferably is a full-function controller with a wide range of options as previously discussed.

The following is a brief summary of a typical sequence of events that takes place when an RC transmitter (remote control 110) is used. The operator presses a button or trigger to open or close the door and the button or trigger causes a pair of electrical contacts to touch, completing a circuit connected to a specific pin of an integrated circuit (IC) 154. The completed circuit causes the transmitter (remote control 110) to transmit a set of sequence of electrical pulses. Each sequence contains a short group of synchronization pulses, followed by the pulse sequence. For example, the synchronization segment—which alerts the receiver to incoming information—is four pulses that have a length X, with intervals Y. The pulse segment, which tells the antenna what the new information is, uses pulses of a predetermined length (time) with predetermined time intervals. The transmitter 140 sends bursts of radio waves that oscillate with a frequency. The garage door opener 100 is constantly monitoring the assigned frequency for a signal. When the receiver receives the radio bursts from the transmitter 140, it sends the signal to a filter 152 that blocks out any signals picked up by the antenna other than at the selected frequency (27 MHz or 49 MHz). The remaining signal is converted back into an electrical pulse sequence. The pulse sequence is sent to the IC 154 in the garage door opener 100, which decodes the sequence and starts a motor of the garage door opener 100 to cause the opening or closing of the garage door 30.

The range of the transmitter 140 will depend on the type and power of the transmitter 140 used in the remote control 110. For example, a walkie-talkie type device can transmit about 1 mile using a 0.25 watt transmitter, while a CB radio, because it has a much higher power, can transmit about 5 miles using a 5 watt transmitter. In addition, the remote control 110 and the garage door opener 100 is configured to operate in the same or similar manner as how a cell phone operates. More specifically, the cell phones operate within cells and they can switch cells as the cell phone moves around. The establishment of these cells give cell phones incredible range and thus, according to one embodiment, a network of cells can be provided to increase the range of the control unit 110 as described in more detail below.

Thus, the foregoing discussion is merely background and provides conventional protocol as to how the remote control 110 or other handheld functions in relation to the other components of the garage door opener 100. In essence, it describes the process by which the remote control 110 (transmitter) and the main control unit (receiver) of the garage door opener 100 communicate with one another.

According to the first embodiment, the remote control 110 and the main control unit 120 of the garage door opener 100 are configured such that at the time that the remote control 110 is used to close/open the garage door 30, the time/date of activity is displayed and stored at least in the memory 132 and memory that is associated with the master/main control unit 120. The memory 118 is configured so that it can store up to a predetermined number of activity logs, such as 25 activity logs. The activity log includes not only the time and date of the last activity but also preferably includes additional information that can be helpful to the operator. For example, an icon showing an open door, when the door 30 is open, and a closed door, when the door 30 is closed, can be provided and displayed on the display 116 so that the operator merely needs to glance at the remote control 110 to easily ascertain the current status of the garage door 30.

The operator can scan through the memory 132 using the user interface 130 to review the stored activity logs. As with any traditional remote control, the button 112 is pressed on the unit 110 to close an opened door. When an icon is presented, the icon can be located next to a particular activity log entry to indicate the status (position) of the garage door 30 when the command action was logged into the memory 132 or the icon can be positioned at a select coordinate region of the display 116.

In this embodiment, the remote control 110 is configured to assist the operator in immediately ascertaining the current status of the garage door 30. The remote control 110 is thus a device that can be consulted to ascertain the status of the garage door 30.

In addition, the operator can review the activity log to check whether there is any unexplained opening of the garage door 30 that could be an indicator of mischief or possibly the commission of a crime. For example, if the operator has left the house and glances down at the status icon and/or the activity log and sees that the garage door was recently opened and/or closed, the operator can take the necessary remedial actions if the operator believes that such activity should not have occurred. The operator can call a neighbor or drive home to check on the condition of the house 10. In addition, the operator can simply press the button on the remote control unit 110 to cause the garage door 30 to close without having to return to the house 10 to close the door 30. Since, in one embodiment, the activity log includes entries showing closing of the door, the operator can simply read the activity log to confirm door closure after pressing the button on the remote control unit 110 to close the door. In other words, the remote control unit 110 confirms that the command to close the garage door 30 was received and processed by the main control unit.

Referring now to FIG. 2 in which a second embodiment is illustrated. In this embodiment, the garage door opener 100 is configured to work in combination with the remote control unit 110 that includes an indicator 160 that signals that the garage door 30 has remained in the open position. In effect, the garage door opener 100 has an active monitoring system that is part of the remote control unit 110 and can be either a visual indicator, an audio indicator or a combined visual/audio indicator that alerts the operator under prescribed conditions that the garage door 30 remains open. When the indicator 160 is at least in part audio based, the remote control unit 110 includes a speaker portion 162 through which an audible sound is heard. When, the indicator is at least in part visually based, the remote control unit 200 includes a light or the like (e.g., one or more LED) or some other type of icon 164 that is illuminated constantly or in a blinking manner. Lastly, when the indicator is audio/visually based, both speaker 162 and light (icon 164) are present. In FIG. 2, icon 164 on the left indicates that the door 30 is closed and the icon 164 indicates that the door 30 is open.

One prescribed condition is that the active monitoring system is activated (i.e., the remote control unit 110 is operative in the active monitoring mode) and the garage door 30 is detected as being open after a predetermined time period has passed after opening of the garage door 30.

In this embodiment as shown in FIG. 4, the garage door opener system 100 includes a detector 200 that is configured to sense the current position of the garage door 30. Any number of detectors 200 can be used so long as they perform the above intended function. For example, the detector 200 can be an optical device that is capable of sensing whether the garage door 30 is in the open or closed position. A typical optical sensor includes a transmitter 202 that transmits a light beam and a receiver 204 that is spaced from but is axially disposed relative to the transmitter 202 such that the transmitted light strikes the receiver 204 when no object obstructs the light beam by being disposed between the transmitter 202 and the receiver 204. If no object is present between the two modules, the light beam freely passes and strikes a sensor of the receiver 204 and a control signal is delivered from the receiver 204 to the detector 200 to indicate in effect that the garage door 30 remains in an open position (since no object is detected as obstructing the light beam).

The garage door opener 100, and more particularly, the main control unit thereof, is preferably constructed such that the detector 200 is activated only after the garage door 30 has been opened. Thus, when the garage door 30 is in the closed position, the detector 200 is in an active mode so as to conserve power, etc. Conversely, the detector 200 is placed in an active mode after the garage door 30 is opened for detection of the current status (position) of the door 30. The detector 200 can be configured so that it activates after a predetermined time period has passed since opening of the garage door 30.

For example, the detector 200 can be constructed so that it emits the light beam either as soon as the garage door 30 is open or after a predetermined period of time has passed after the opening of the garage door 30. Since the garage door 30 is open, the light beam is not obstructed by the door 30 and strikes the receiver 204 and a signal is sent to the detector 300 indicating the open position of the door 30. The garage door opener 100 according to this embodiment is designed so that if the detector 200 senses that the garage door 30 remains open for a predetermined period of time, after the opening thereof, an alert signal is sent from the main control unit to the remote control unit 110 resulting in the audio and/or visual indicators being activated to cause either an audio alarm, a visual alert or a combination of both.

The predetermined period of time that must pass before the indicator 210 is activated, with this period of time being programmable and can be set by the operator. For example, the predetermined period of time can be on the order of 3 minutes or some other time period which can be set by the operator using the remote control unit 110 and more particularly, through the user interface 130 thereof. Thus, the operator is able to set the time period the passing of which triggers the activation of the indicator 160. After the operator has been alerted to the open door condition, the operator can then investigate the matter and take the necessary remedial action, which may be shutting the garage door 30, notifying the appropriate authorities, etc. The operator can shut off the indicator 160 at the main control unit 120 or preferably, can be shut off at the remote control unit 110.

Conversely, if after the predetermined time period has passed and the detector 200 senses that the garage door 30 is closed, the main control unit 12 of the garage door opener 100 is signaled as to the closed position of the garage door 30 and the detector 200 can be placed in the inactive mode. Moreover, if the operator is opening the door 30 and wishes for the door 30 to remain in the open position for a considerable period of time greater than the predetermine alert time period, then the operator can simply shut off the active monitoring system so that the detector 200 is not activated and the indicator 160 is likewise not activated. The operator can preferably shut off the active monitoring system or mode either through the remote control unit 110 or through the permanent control unit 120. For example, if the operator wishes to open the door 30 to access gardening tools and then wishes to leave the door open while performing yard work or wishes the door to be open to permit washing of the car or simply wishes to air out the garage 20 while the operator is home, the active monitoring system can be turned off. Alternatively, the control units can be configured so that once the operator closes the garage door 30, a control signal is sent from the main control unit to the transmitter (remote control unit 110) instructing the unit 200 to deactivate and shut off the alarm/indicators.

In yet another embodiment, the garage door opener 100 can be configured so that after the predetermined time period passes, not only is the indicator 160 activated to alert the operator that the garage door is open but it also can be configured so that, if the operator takes no remedial action within a predetermined time period, after being alerted that the garage door is open, the main control unit 120 can instruct the garage door 30 to close. Thus, in this embodiment, the garage door opener 100 has an active door closing feature that can be activated or disabled through the user interface 130 that is part of the remote control unit 110 and the main control unit. Thus, if the operator is alerted to the open door condition by the indicator 160 but can not take active remedial action, e.g., the operator is preoccupied with driving and can not stop and pull off the road, then the operator can simply take no action and after a predetermined time period (e.g., 1 minute) passes, the garage door 30 automatically is closed. This mode can be activated or turned off via user interface 130, e.g., in a menu.

Now turning to FIG. 3 in which a third embodiment is illustrated which is similar to the two previous embodiments. The difference is that in this embodiment, the active monitoring system includes a confirmation chime or confirmation means to inform the operator that the garage door 30 is in the closed position.

The main control unit 120 of the garage door opener 100 can send a confirmation signal to the remote control unit 110 that results in the audio and/or visual indicators being activated to alert the operator that the garage door 30 has been closed. For example, the main control unit can send a confirmation signal to the remote control unit 110 that causes a confirmation chime or some other type of audio signal to be heard through the speaker 162. The confirmation can also be in the form of a visual indicator, such as a constant illuminated light or a blinking light that forms a part of the remote control unit 200. It will also be appreciated that the confirmation can be in the form of both an audio and visual indicator as previously described.

Moreover, the confirmation means can be in another form, such as a text message, that scrolls across the display 116. The text message can simply state "GARAGE DOOR IS CLOSED" or it can state "CONFIRMATION OF CLOSED DOOR". The text message can be combined with an audio indicator. Similarly, a closed door icon can be used in combination with an audio indicator to alert and confirm to the operator that the garage door 30 is in the closed position.

Figure 5:
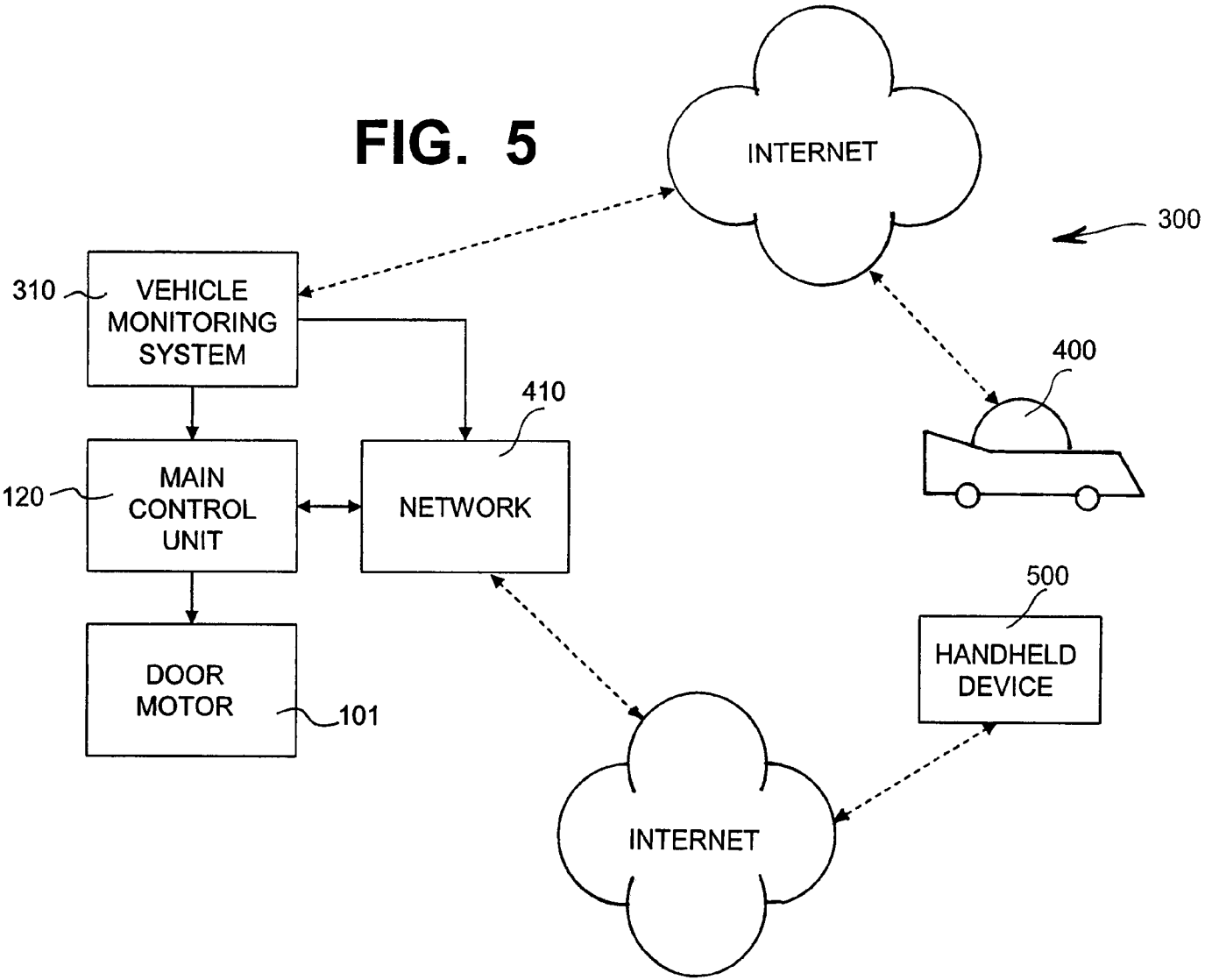
FIG. 5 is a schematic view of a vehicle monitoring system for use in combination with the garage door opener system of FIG. 1.

In yet another embodiment illustrated in FIGS. 3 and 5, the active monitoring system of the garage door opener 100 is a network based system 300, such as an internet based system, that is configured to send an alert message to the operator over a network 410. More specifically, the garage door opener 100 includes not only a detector or sensor, such as detector 300, that monitors whether the garage door is in an open or closed position, but it also has a vehicle monitoring feature 310 that monitors a vehicle 400 and its relative position to the garage door 30. The vehicle monitoring feature 310 is a system that monitors and is capable of detecting whether the vehicle 400 is driving away from the garage 20. For example, the vehicle monitoring feature 310 is of the type that is capable of detecting the position of the vehicle 400 relative to the garage 20 and can constantly calculate the distance between the garage 20 and the vehicle so as to be able to detect whether the vehicle 400 is moving towards the garage 20 or away from the garage 20.

For example and according to one embodiment, the vehicle monitoring feature 310 is a GPS based system that is able to determine the location of the vehicle 400 (on a coordinate map) relative to the garage 20. The GPS system also is able to track the movement of the vehicle 400 relative to the garage 20 so that a distance between the vehicle and the garage is constantly calculated or calculated at prescribed intervals over a set period of time. By monitoring the running distance between the vehicle and the garage 20, the system 310 can detect whether the vehicle 400 is moving towards or away from the garage 20. In one configuration, the vehicle monitoring system 310, once activated, monitors and calculates the distance between the house 10 and the vehicle at predetermined intervals, e.g., 20 seconds, over a predetermined time period (e.g., 2-4 minutes) and therefore, is able to detect whether over this predetermined time period if the vehicle is moving towards or away from the house 10. If the vehicle monitoring system 310 calculates that the vehicle is moving away from the garage 20, then the system 310 sends a control signal to the main control system indicating that a threshold has been met concerning vehicle travel from the garage 20.

Moreover, the system 310 can be designed so that in order for the system 310 to send a control signal indicating that the vehicle is traveling away from the garage 20, the distance that the vehicle has traveled over the predetermined time period has to meet some threshold, such as being greater than a predetermined mileage value, e.g., that the vehicle traveled more than 0.5 miles over the predetermined time period.

In this embodiment, if the garage door opener 100 detects that the door is open under prescribed conditions and that the vehicle is traveling away from the garage 30, then the garage door opener 100 (main control unit 120 thereof) sends an alert via the network 410 to a handheld device 500 of the operator indicating to the operator that the garage door 30 is in the open position.

The handheld device 500 is a preferably a wireless device that communicates with the main control unit 120 of the garage door opener 100 via the network 410. The precise form of the handheld device 500 is not critical for the practice of the present invention and there are a number of different handheld devices that are suitable for use as the handheld device. For example, the handheld device 500 can be in the form of a cellular phone that is capable of receiving text messages or emails, a pager, a personal computer, or a personal digital assistant (PDA), or any other unit that is connected to the internet or is capable of receiving a communication, such as a message or alert, etc.

The alert is typically in the form of a message, e.g., a pre-recorded voice message, a text message, an email, etc., which indicates and alerts the operator that the garage door 30 is detected as being open. According to one aspect of the present invention, the user can input up to a predetermined number of contacts, as well as related contract information, such as a telephone number or email address, that will be contacted in the case of an emergency or when the system determines that an alert is to be sent. For example, the system can be configured to allow up to six contacts to be added for contacting in the event of a triggering event. The system is preferably configured so that the operator can specify the order or the contacts and should be able to classify how many of the contacts are to be contacted for a certain event. For example, the operator may wish for only contacts 1 and 2 to be alerted when the triggering event is of a first type and contacts 1-6 to be alerted when the triggering event is of a second type, such as detection of fire, etc. The system also preferably is configured to contact the contacts sequentially in that it can place phone calls or send text messages or emails sequentially to up to six people, etc.

Once the operator is alerted that the garage door is open, the operator can then take the appropriate actions to remedy the situation. For example, the garage door opener 100 can be configured so that the operator can close the garage door 30 by clicking on a link in the email alert which takes the operator to a specific website (e.g., garage door opener active monitoring website). At this particular website, the operator signs in and can command the system 100 to close the door 30. If the operator does instruct for the garage door 30 to be closed, then the website will in effect deliver a command message or signal through the network 410 to the main control unit 120 (using wireless communication protocol) of the garage door opener 100. The main control unit then delivers a command signal to the garage door mechanism that mechanically closes the garage door 30. As previously mentioned, upon closing of the garage door 30, a confirmation signal can be sent to the operator. In this case, the confirmation signal would be sent through the handheld device 500.

For added security, the vehicle monitoring system 310 also alerts the operator via email during preset time periods once it senses the garage door 30 being opened. The operator can set the time period that the operator wishes to be monitored via the website. The operator can choose the time period in which the operator is certain that no authorized person will try to gain entry via the garage door 30. This could include normal working hours and vacation time periods. If the operator is aware of an upcoming authorized entry, he would then have the system ignore a certain number of entries to his/her home. Again, this could be done at the garage door opener active monitoring website. The operator would just need to sign in, pick one or more dates from an online calendar and enter the amount of entries to ignore. In addition, the website can be constructed so that the operator can enter a particular time frame in which authorized entry is permitted by an authorized use of the remote control unit 110 or handheld device 500 or the permanent unit 120 or some other keypad or the like into which the operator enters a code, etc.

The vehicle monitoring system 310 is preferably only activated after the sensor/detector 200 senses that the garage door 20 is open and certain prescribed conditions are met. These prescribed conditions include but are not limited to: (1) the active monitoring system is active; and (2) the garage door remains open for a predetermined time after being opened by the operator.

This particular aspect of the present invention addresses the rash of burglaries occurring throughout the nation, in which burglars have gained access to homes through the garage door 30. In particular, burglars have found a way of opening the garage door 30 using special devices that can record the entry code signal sent from the remote control unit for the garage door to the main control unit of the opener. Once this code is obtained by the burglars, they can use the code to gain access to the inside of the garage whenever the homeowner is not home and as a result may be able to gain entry to the living quarters of the house through the garage.

In yet another embodiment, the active monitoring system can be based on the principles that underlie an underground pet fence and is formed of a transmitter (main control unit of the garage door opener), an underground wire that extends at least across all vehicle entrances and exits, and a receiver that is part of the remote control unit. The transmitter plugs into a standard electrical outlet. It emits a radio signal that travels through the installed underground wire. The buried wire is just that—a single strand of insulated wire—that makes a loop from the transmitter around the property (entrances and exits) and back to the transmitter. The transmitter uses the buried loop of wire to broadcast a radio signal. The signal is normally very simple—just a sine wave, or possibly two sine waves at different powers; and the buried wire acts as an antenna and turns the signal into electromagnetic waves. The transmitter does not use a lot of power, so the signal around the wire has a very small range—perhaps 10 or 15 feet. In some systems the wire has two signals running through it—one at low power and one at a higher power. Inside the remote control unit is a small radio receiver (essentially an AM radio very similar to a $5 battery-operated AM radio you would buy at a discount store). When this radio gets close enough to the buried wire, it receives the signal that the wire transmits. This type of system can be constructed so that once it is activated; either concurrently when the garage door is open or after a predetermined period of time passes after opening of the garage door, when the remote control unit in the traveling vehicle approaches the buried fence and is within the appropriate range thereof, either an audio indicator (beep(s)) or visual indicator (blinking or solid light) or a combination thereof will be activated in the remote control to alert the operator that he/she is leaving the property boundary while the garage door is open.

In yet another embodiment, the garage door opener system of the present invention is configured to include a "call back" feature or mode of operation. In this mode of operation, a first input value is inputted into the main control unit 120 or a the user can simply accept the default first value which represents a length of the time that the garage door is open after an opening event. More specifically, once the user opens the garage door using conventional means and the system is in the call back mode, the main control unit 120 begins to calculate and keep track of the elapsed time since the door was opened.

The call back mode is designed so that if and when the elapsed time eclipses the first input value or the default first value, the garage door opener system takes affirmative action in that the system will communicate with a device that is associated with a stored telephone number, etc. In other words, the user inputs into memory at least one telephone number or some other identification number that is capable of establishing a connection between the garage door opener system and the device. For example, the number can be the number of a cellular phone, a land phone or some other type of telephone device or the stored number can be associated with another type of personal device, such as a PDA or a Blackberry type device. If the trigger point or threshold is reached (when the elapsed time exceeds the first value), then the garage door opener system of the present invention is designed to communicate with the device as by placing a call to the device or by otherwise sending an alert or the like. For example, a message that consists of synthesized speech, computer generated speech, or the like can be delivered to the device at the call back number alerting the person that the garage door has been left open for a predetermined amount of time. Accordingly, the message can state "Alert—your garage door has been open for the past X minutes", where X is the present elapsed time of the door being open. When the first alert or message is sent, the value of X should be equal to the value of the first value (threshold value) since the first alert/message is sent as soon as the threshold value is met or exceeded. In subsequent alerts, the value of X will be greater than the threshold value. Of course, any number of other messages can be sent and delivered to the person by means of calling the device. In yet another embodiment, a text message can be sent to the user instead of human speech. In the case of synthesized speech, the message is capable of being stored in a voice mail or message system of the user's device and thus, if the user does not answer the call, the alert message can still be delivered to the user.

It will therefore, be appreciated that the threshold value (inputted first value) is selected so that normal everyday usage of the garage does not trigger the generation and sending of a message. In other words, if the user arrives home and opens the garage door to park his/her vehicle and then collects his/her belongings and mail, or the like, the elapsed time of these events is less then the threshold value and therefore, the user does not receive a call. Since the user can select and change the value of the elapsed time, the user can determine how much is normally necessary for him/her to leave the door open to accomplish every day tasks, etc.

In yet another aspect, the call back mode preferably includes a bypass feature in which the user can deactivate/disable the call back mode. For example, if the garage door opener system is in the call back mode and the user desires to keep the garage door open for an extended period of time that will exceed the threshold value, the user can simply activate the bypass function and the call back mode is temporarily suspended or inoperative for a select period of time or until the user reactivates the call back mode. For example, when the user is at home and wishes to leave the garage door open due to the user needing constant or extended access to the garage as when the user is cleaning the garage or cleaning a vehicle or generally is working outside and simply wishes to have easy access to the house. The bypass feature preferably has a lifespan that can be inputted into the system and indicates to the system when the bypass feature should be automatically deactivated. The lifespan or activation life (elapsed time) of the bypass mode can be set by the user by inputting the value into the system or the user can simply accept the programmed default value, e.g., 12 hours. It will be therefore be appreciated that the user can easily set the bypass mode to be operational for a predetermined number of hours, such as 2, 3, 4, etc., or a longer time such as 6, 7 or 8 hours or even 12 hours, or a predetermined number of minutes, e.g., 30, 40 minutes, etc. It will be understood that when the system is in bypass mode, the user can still open and close the garage door freely and the reopening of the garage door does not trigger the restarting of the call back mode. In other words, it does not cancel the bypass mode operation. The activation life feature of the bypass mode ensures that even if the user forgets that the bypass mode has been selected, the call back mode will be reactivated as the master default condition after the activation life ends. This protects against the user forgetting that the bypass mode is selected since the bypass mode will naturally expire on its own without any affirmative action being taken by the user.

Figure 6:
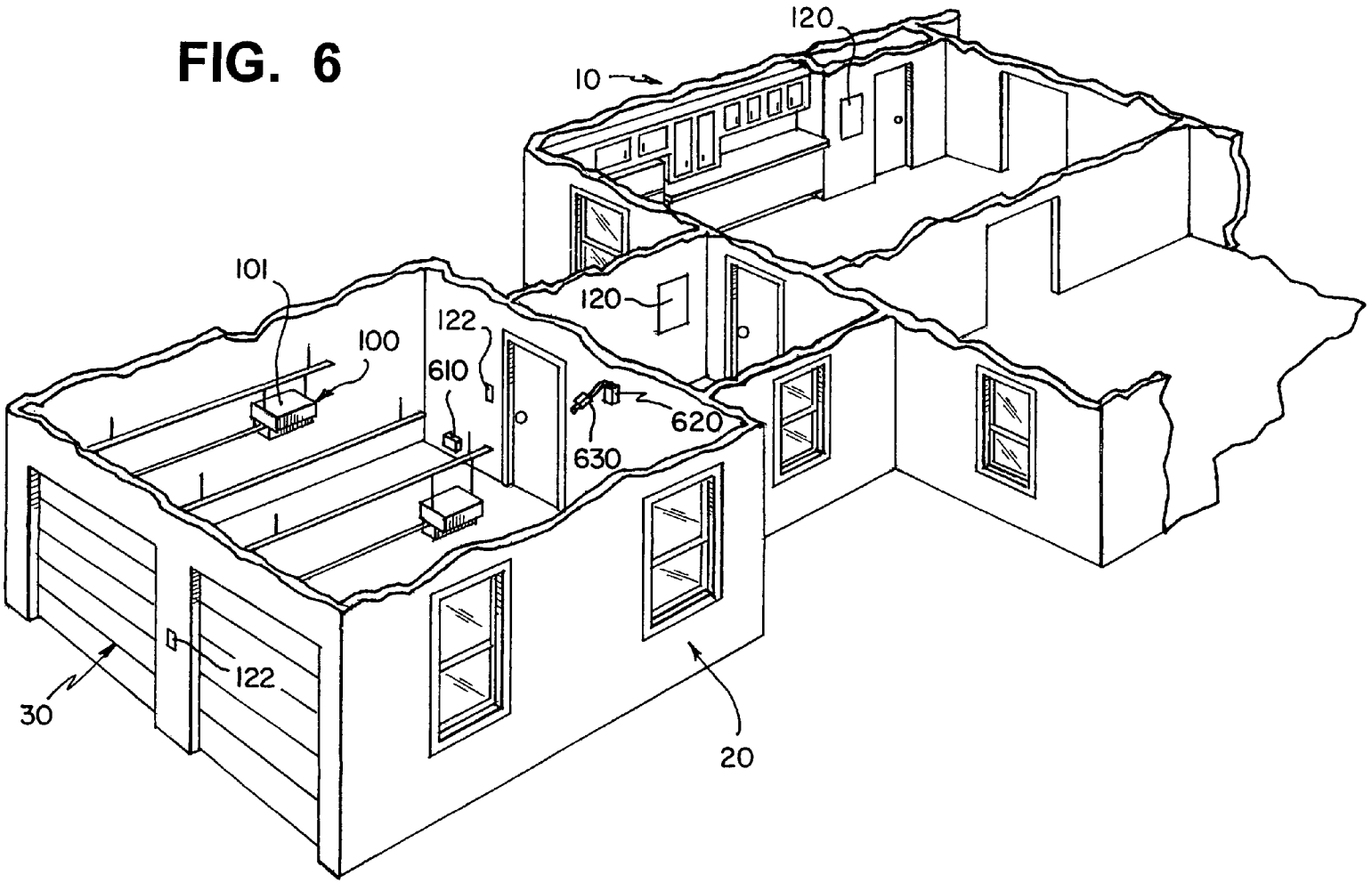
FIG. 6 is a perspective view of a house with a garage door opener and gas safety system according to the present invention.
Figure 7:
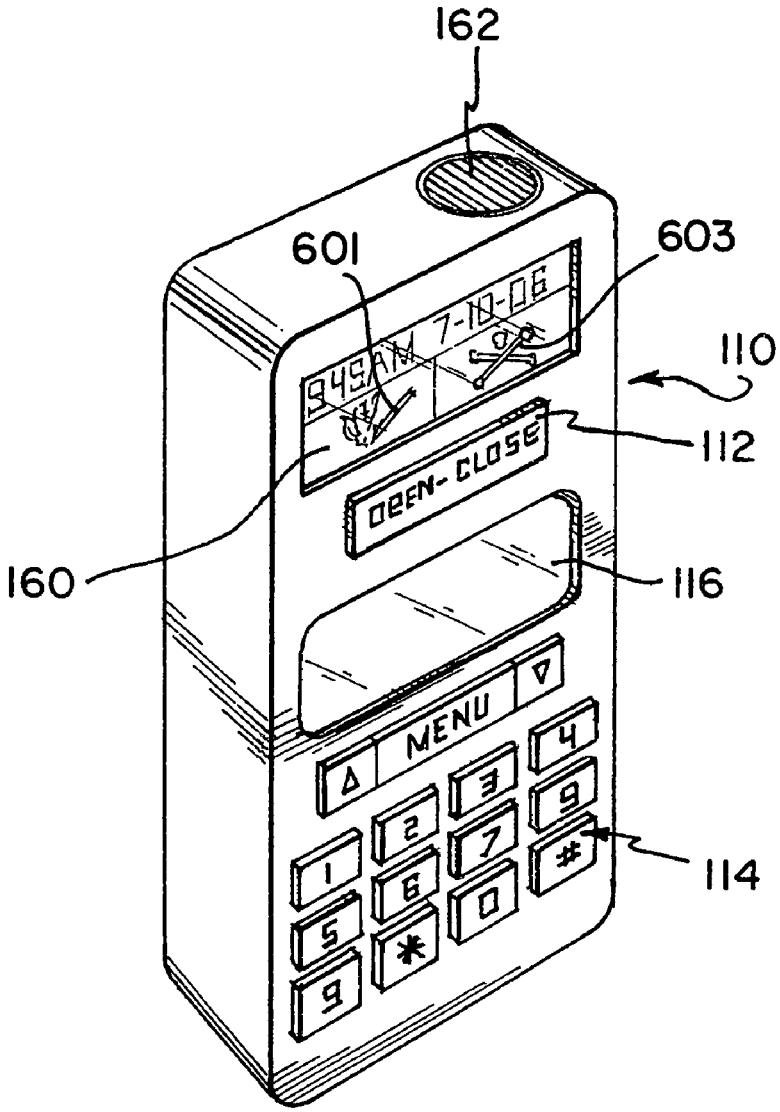
FIG. 7 is a perspective view of remote control unit for use with the door opener and gas safety system of FIG. 6.

Referring now to FIGS. 6-7 which illustrate another aspect of the present invention. The embodiment shown in FIGS. 6-7 is very similar to the prior embodiments in that it includes one of the previously-described automatic garage door openers of the present invention; however, this embodiment also further includes a gas safety feature or system, generally indicated at 600, that is operatively coupled to and in communication with the master (main) control unit 120.

The gas safety system 600 is intended to monitor and alert the home owner to an undesirable and potentially damaging and lethal condition within the house 10 and in particular, within or in close proximity to the garage 20. As described in detail below, the gas safety system 600 is configured so that it instructs the main control unit 120 to take some type of remedial action and to alert the home owner to the condition.

In one exemplary embodiment, the gas safety system 600 is in the form of a unit that can detect the presence of a gas within a surrounding space, such as the garage 20. For example and according to one embodiment, the system 600 includes a detector 610 that detects the presence of a gas, such as smoke and/or carbon monoxide. As is well know, carbon monoxide is known as the "invisible killer" since it is a colorless and odorless gas whose buildup, even in small quantities, in an enclosed or poorly vented area can be lethal.

The detector 610 is illustrated as being located within the garage 20 and can be located at any number of different locations, such as at a ceiling or wall location. In accordance with the present invention, the detector 610 is operatively connected to the main control unit 120 by any known techniques, including hard wiring the two together for direct communication therebetween or by having an indirect communication as in the case of a wireless system. When the detector 610 is part of a wireless system, it will typically include a transmitter or the like to send a signal to the main control unit 120 upon the occurrence of a triggering event, such as the presence of an excessive level of gas (e.g., carbon monoxide) within the garage 20. It will be understood that the detector 610 can be any number of different commercially available units that offer the protection that is desired in the intended application; however, one preferred embodiment is where the detector is a carbon monoxide detector since several of the biggest sources of carbon monoxide gas, namely, a vehicle and a boiler or the like, are typically located either directly in the garage 20 or in close proximity thereto so that a carbon monoxide reading taken in the garage 20 provides an accurate and timely indication of the initial buildup of gas before it reaches a more dangerous level.

The garage door opener, such as opener 100, and the system 600 are designed so that if the detector 610 senses that the target gas exceeds a predetermined threshold (e.g., concentration) in the garage 20, then an alert signal is transmitted or otherwise delivered from the detector 610 to the main control unit 120. The main control unit 120 is configured so that upon receiving the alert signal a control signal is sent to the garage door opener 100 causing the door to be opened, thereby venting the garage 20 with outside air. In addition, an alert signal is sent from the main control unit to the remote control unit, such as unit 110, resulting in an audio and/or visual indicators being activated to cause either an audio alarm, a visual alert or a combination of both, to be activated to alert the home owner to potentially dangerous condition and to the fact that the garage door 30 is open.

In this embodiment, the unit 110, as shown in FIG. 7, can include an icon or the like which indicates that the door 30 was opened due to the presence of excessive gas levels in the garage 20. For example, the icon can be in the form of a flame 601 or can be in the form of a skull and bones icon 603 to indicate the presence of a lethal gas or smoky condition. By automatically opening the garage door 30, the garage 20 can be vented and hopefully the potentially dangerous condition is avoided.

It will be understood that the alert signal is not limited to being delivered to the remote control unit 110 but instead can be delivered via the network 410 to a handheld device 500 (FIGS. 3 and 5) of the operator indicating to the operator that the garage door 30 is in the open position. In addition and in order to differentiate amongst the different reasons why the garage door 30 was opened, the remote control unit 110 and/or handheld device 500 can include an icon or the like which indicates that the door 30 was opened due to the presence of excessive gas levels in the garage 20. For example, the icon can be in the form of a flame or can be in the form of a skull and bones icon, as shown in FIG. 7, to indicate the presence of a lethal gas or smoky condition. By automatically opening the garage door 30, the garage 20 can be vented and hopefully the potentially dangerous condition is avoided.

At the same time, the main control unit 120 can be configured so that it sends an alert signal to a private security/safety monitoring company and/or local authorities, such as the police or fire department, to alert them as to the potentially dangerous condition and the address of the home owner so that the company and/or authorities can investigate the matter.

As previously mentioned, the handheld device 500 can be a wireless device that communicates with the main control unit 120 of the garage door opener 100 via the network 410. The precise form of the handheld device 500 is not critical for the practice of the present invention and there are a number of different handheld devices that are suitable for use as the handheld device. For example, the handheld device 500 can be in the form of a cellular phone that is capable of receiving text messages or emails, a pager, a personal computer, or a personal digital assistant (PDA), etc.

The alert is typically in the form of a message, e.g., a pre-recorded message, an email, etc., which indicates and alerts the operator that the garage door 30 is detected as being open and that the gas detector 610 has detected the presence of gas that exceeds the predetermined threshold. Once the operator is alerted that the garage door is open, the operator can then take the appropriate actions to remedy the situation.

It will therefore be appreciated that the system 600 is an extra safety measure that is added to one of the existing garage door opener system previously described herein. Not only is the system 600 designed to alert the home owner to the existence of a potentially dangerous condition but also the system 600 is designed to be an active system that initiates active, affirmative remedial steps, such as opening the garage door 30 to vent the enclosed area. In the case where a running vehicle or faulty boiler in the garage is the source of the potentially lethal gas, the opening of the garage door 30 will allow air from outside to enter and vent the garage 20, thereby reducing the gas buildup in the garage. At the same time, by alerting at least the home owner and perhaps the authorities and/or a security company, additional steps can be taken to correct the problem.

It will be appreciated that the detector 610 can include more than one type of sensing component and more specifically, the detector 610 can be of the type that readily differentiates between a first type of gas, such as smoke, and a second type of gas, such as carbon monoxide. This permits the detector 610 to send a number of different alert signals that are specific relative to the type of gas sensed in the location. Depending upon the type of gas sensed and the signal sent, different remedial steps may be taken.

It will further be appreciated that the system 600 can be designed such that after either a prescribed time or once the gas concentration falls a certain degree below the threshold amount, the home owner can remotely shut the garage door 30 by sending a control signal to the master control unit 120 which in turn signals the garage door opener 100 to close. If this action is taken, the system 600 can be configured so that it resets itself and begins monitoring the garage 20, etc., and in the case where the gas builds back up and exceed the concentration threshold, the detector 610 will once again signal the door 30 to open.

In yet another embodiment, the system 600 includes a video surveillance system 620, such as a micro video camera 630, that permits the home owner to look in the garage space 20 and monitor the situation and then decide whether to close the door via the remote control or to inspect in person or take some other action. For example, after receiving an alert notification on the remote control or handheld device that a gas buildup has been detected in the garage 20 and the garage door 30 has been opened, the home owner can then activate the video surveillance feature by pressing a button on the remote or handheld unit which causes a captured image to be displayed on the display screen on the remote or handheld device. In this way, the home owner can view the inside of the garage after receiving the alert that a gas buildup has been detected. In the case that the detector 610 detects a fire or smoky condition, the home owner can view where the smoke is coming from and take any remedial actions that might be necessary. In the case of a carbon monoxide alert, the home owner can view the garage to see if a vehicle is in the garage and more importantly, if any individuals are in the garage. The video system 620 can be configured to that the image can either be a still photograph image or the image can be a live video stream.

In yet another embodiment, the system according to the present invention can be configured so that the system can notify the user in the event that the garage door 30 is opened again (reversed) due to an obstruction in the path of the garage door 30. For example, the user may be driving off and sees that the garage door 30 is closing and believes that the garage door 30 will fully close; however, an obstruction in the path of the door 30 prevents the door 30 from shutting. Most, if not all, modern garage door openers contain a sensor system that detects an obstruction to the door closing operation and is designed to immediately reverse its travel and return to the open position.

When the system is programmed to operate in an alert mode, the system is configured so that as soon as the sensors of the garage door opener sense an obstruction and instruct the door 30 to be reversed and reopened, a control signal is sent to the present system to alert the present system that the door 30 is being reversed to the open position. The present system receives this signal and is designed to alert the homeowner, etc. in any one of the manners previously described herein, including sending an alert message to a handheld device, such as a cellular phone, PDA or sending an email to one or more contacts or placing a call with a pre-recorded message to one or more contacts.

Since this mode activates and sends an alert only when the garage door sensor operates and detects an obstruction, an alert is not generated when the garage door 30 is merely opened after being closed but rather, the controller of the opener receives a signal and discerns that it is of the type that indicates that the garage door 30 reversed itself and reopened due to an obstruction. By sending and receiving the alert, the homeowner can return to the house while still in close proximity and determine what caused the reversal of the garage door 30, such as an object on the garage floor in the path of the garage door 30.

In yet another aspect, any one of the modes of the system according to the present invention can be configured so that it can send, in addition to an alert to the handheld device, an alert to the inside of the house. For example, an audible alarm whose speaker is located inside the house can be operatively connected to the garage door opener so that activation of the alert mode in the garage door opener system for any one of the reasons discussed above, e.g., expired time period with the garage door in the open position, detection of dangerous CO gas, obstruction of garage door path, opening of the door when not expected, etc., causes an alert/alarm to be delivered or sounded in the home itself. For example, a speaker with an optional warning light can be installed at a logical location within the home such that when one of the alert events is triggered, the alarm is sounded and optionally, a light or the like can be illuminated (e.g., flashing or constant manner).

It will also be understood that the system can be directly linked to the doorbell mechanism such that activation of the alert or alarm causes an audible alert or alarm to be heard in the home. In either of these systems, the homeowner can then take remedial action or at least inspect the garage to see whether and why the garage door 30 is open.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. An active monitoring system for use with an automatic garage door opener that is installed in a garage comprising: means for sending an alert to a remote control unit that is in communication with the automatic garage door opener when a prescribed event occurs; means for opening the garage door upon occurrence of the prescribed event and a vehicle monitoring means that detects a position of a vehicle, that carries the remote control unit, relative to the garage and calculates whether the vehicle is moving towards the garage, the means for sending an alert including a main control unit that takes into consideration information received from the vehicle monitoring means when determining whether the alert is to be sent.

2. The active monitoring system of claim 1, wherein the main control unit is configured to send a control signal to the automatic garage door opener to open and close the garage door and to send or receive the alert.

3. The active monitoring system of claim 2, wherein the remote control includes a display that displays an activity log that is stored in memory of the remote control and journals at least a time and date when the garage door is opened and closed.

4. The active monitoring system of claim 3, wherein the remote control includes: a user interface that permits a main menu to be accessed for performing at least one operation selected from the group consisting of: scrolling the activity log, setting a type of alert, and changing a display format.

5. The active monitoring system of claim 3, further including: a clock that is displayed on the display to indicate a current time and to display a time entry for each entry in the activity log.

6. The active monitoring system of claim 3, wherein the display displays a graphic icon that indicates whether the garage door is in an open position or a closed position and an icon that represents the occurrence of the predetermined event.

7. The active monitoring system of claim 2, further including: a video surveillance system that is operatively connected to the main control unit such that upon the occurrence of the prescribed event, the video surveillance system can be activated via the remote control unit to view an interior of the garage.

8. The active monitoring system of claim 1, wherein the alert is selected from a group consisting of an audio alert, a visual alert, and a combination of audio and visual alerts.

9. The active monitoring system of claim 1, wherein the prescribed event is the detection of a gas within the garage at a concentration greater than a predetermined threshold.

10. The active monitoring system of claim 1, wherein the means for opening the garage door is configured such that upon detection of a prescribed gas in a concentration exceeding a threshold concentration, a detector sends an alert signal to the main control unit which in turn sends a control signal to the garage door opener causing the garage door to open.

11. The active monitoring system of claim 1, further including: a network over which the alert is delivered to a handheld device which comprises the remote control unit.

12. The active monitoring system of claim 11, wherein the handheld device comprises a device selected from the group consisting of: a cellular phone, a pager, a personal computer, and a personal digital assistant.

13. The active monitoring system of claim 12, wherein a main control unit of the garage door opener is in wireless communication with a website that includes a user accessible menu that includes a garage door closing feature that permits a command signal to be sent over the network to the main control unit causing the garage door to be closed.

14. The active monitoring system of claim 13, wherein the alert comprises an email that includes a link to the website.

15. The active monitoring system of claim 1, wherein the vehicle monitoring means is a GPS based system that is able to determine the location of the vehicle relative to the garage and calculate, over a prescribed time period, a distance between the vehicle and the garage, thereby allowing the vehicle monitoring means to calculate whether the vehicle is moving towards the garage.

16. The active monitoring system of claim 15, wherein if the vehicle monitoring means calculates that the vehicle is moving away from the garage, a control signal is sent to the main control unit indicating that a threshold has been met concerning vehicle travel from the garage, thereby permitting the alert to be generated and sent to the handheld device.

17. The active monitoring system of claim 1, wherein the prescribed event comprises the opening of the garage door and the determination that the vehicle is moving away from the garage.

18. An automatic garage door opener comprising: a mechanical mechanism operatively coupled to the garage door for opening and closing thereof; a main control unit for processing command signals to open and close the garage door; a handheld device in operative communication with the main control unit and capable of sending the command signals; an active monitoring system that is operatively associated and in communication with the main control unit and the handheld device, the active monitoring system being configured to send an alert to the handheld device after the garage door is open and upon the occurrence of a prescribed event; and a network over which the alert is delivered to the handheld device; and wherein the prescribed event is when the system is in an active monitoring mode and the garage door is in an open position for more than a predetermined period of time inputted by a user, wherein once the predetermined period of time passes, the system enters a call back mode and the main control unit sends the alert to a device that is associated with a programmable stored identification number, the system having a bypass mode in which the user can disable the automatic call back mode, the system further being capable of detecting a gas within the garage at a concentration greater than a predetermined threshold, the main control unit being configured to deliver a control signal to open the garage door when the concentration of the gas is greater than the threshold and wherein the active monitoring system is configured so that the handheld device can remotely send a control signal to the main control unit to close the garage door after the detection of gas concentration exceeding the threshold and after the alert has been delivered to the handheld device, the active monitoring system resetting itself if the garage door is closed using the handheld device.

19. The active monitoring system of claim 18, wherein the main control unit and the handheld device of the garage door opener are in wireless communication via the network with a website that includes a user accessible menu that includes a garage door closing feature that permits a command signal to be sent over the network to the main control unit causing the garage door to be closed after the alert is sent to the handheld device.

20. The active monitoring system of claim 19, wherein the user accessible menu provides access to a video surveillance system that is operatively connected to the main control unit such that upon the occurrence of the prescribed event, the video surveillance system can be activated via the remote control unit to view an interior of the garage.

21. The active monitoring system of claim 18, wherein the handheld device comprises a device selected from the group consisting of: a cellular phone, a pager, a personal computer, and a personal digital assistant.

22. An active monitoring system for use with an automatic garage door opener that is installed in a garage comprising: a main control unit including a transmitter in the form of an underground wire that extends at least underneath all vehicle entrances and exits, the main control unit including means for sending an alert to a remote control unit that is in communication with the automatic garage door opener when a prescribed event occurs, the remote control unit including a receiver that is configured to receive a signal emitted by the transmitter.

23. The active monitoring system of claim 22, wherein the prescribed event comprises the vehicle crossing the underground wire when the garage door is open.

24. The active monitoring system of claim 22, wherein the active monitoring system activates upon occurrence of an event selected from the group consisting of the opening of the garage door and expiration of a predetermined period of time passes after opening of the garage door.

25. The active monitoring system of claim 22, wherein the alert is one of an audio indicator, a visual indicator and a combination thereof that is activated at a location of the remote control unit to alert a user that the vehicle is leaving the property while the garage door is open.

* * * * *